United States Patent [19]

Mannon, Jr.

[11] 4,267,893

[45] May 19, 1981

[54] DUAL-ROTATING ECCENTRIC DRILLING APPARATUS AND METHOD

[75] Inventor: Alfred T. Mannon, Jr., Santa Maria, Calif.

[73] Assignee: Union Oil Company of California, Brea, Calif.

[21] Appl. No.: 69,797

[22] Filed: Aug. 27, 1979

[51] Int. Cl.[3] ..... E21B 4/02

[52] U.S. Cl. ..... 175/65; 175/107

[58] Field of Search ..... 175/65, 67, 95, 96, 175/103, 101, 104, 106, 107, 319, 404, 91

[56] References Cited

U.S. PATENT DOCUMENTS

| | | | |
|---|---|---|---|
| 1,254,267 | 1/1918 | Pickin . | |
| 2,511,831 | 6/1950 | Adamson | 175/319 |
| 2,709,574 | 5/1955 | Arutunoff | 175/101 |
| 3,161,243 | 12/1964 | Davis | 175/95 |
| 3,640,352 | 2/1972 | Stuart | 175/107 |
| 3,682,258 | 8/1972 | Kelly, Jr. et al. | 175/96 |
| 3,835,942 | 9/1974 | Leonardi | 175/104 X |
| 4,102,415 | 7/1978 | Cunningham | 175/104 |

FOREIGN PATENT DOCUMENTS

| | | | |
|---|---|---|---|
| 155368 | 11/1951 | Australia | 175/96 |

*Primary Examiner*—James A. Leppink
*Assistant Examiner*—Richard E. Favreau
*Attorney, Agent, or Firm*—Dean Sandford; Daniel R. Farrell

[57] ABSTRACT

Apparatus and method for drilling a borehole in which an undersized drill bit mounted eccentrically within the borehole is rotated about its axis in engagement with the bottom of the borehole by means of a downhole motor while the drill bit is simultaneously rotated in a planetary motion about the axis of the borehole.

19 Claims, 4 Drawing Figures

DUAL-ROTATING ECCENTRIC DRILLING APPARATUS AND METHOD

BACKGROUND OF THE INVENTION

1. Field of the Invention

This invention relates to methods and apparatus for drilling boreholes, and more particularly relates to methods and apparatus for drilling boreholes by means of a drill bit driven by a downhole motor.

2. Description of the Prior Art

The continuing search for oil and gas reservoirs has resulted in the drilling of boreholes to greater depths than had previously been conventional. At depths of 10,000 feet and below, the drilling capabilities of conventional rotary drilling rigs are often limited because the greater length of the tubular drill string required severely limits the rotational speeds at which the drill string and bit can be rotated without overstressing the drill string. The risk of breaking the drill string and the resulting down-time to recover the severed pipe have typically made the operators reluctant to operate at rotational speeds above about 50 revolutions per minute (r.p.m.).

However, at such low rotational speeds, relatively low formation penetration rates result with the use of diamond drill bits, which bits are ordinarily preferred in order to minimize the frequency of replacement. In fact, diamond drill bits generally achieve maximum economic penetration rates at speeds between about 400 and about 800 r.p.m. which speeds are not practical with conventional rotary rigs. This problem has been avoided to some extent by the use of a downhole motor to rotate a full-sized drill bit at high speeds.

Other problems encounted in the rotary drilling of boreholes with conventional apparatus and methods include the tendency of most full-sized drill bits to cut cores due to the relatively slow speed at which the centermost cutting elements of the drill bit move as compared to the relatively high speed of the outermost cutting elements. When the drill bit is rotated about a fixed axis relatively minor damage to the drill bit can result in the excessive wearing of a ring of cutting elements, thereby preventing further penetration and requiring replacement of the drill bit before full use can be made of all the cutting elements. Thus a need exists for an improved apparatus and method for drilling boreholes.

Accordingly, it is a primary object of this invention to provide an improved apparatus and method for drilling boreholes which overcome the aforementioned deficiencies of the conventional drilling apparatus and methods.

Another object of this invention is to provide an improved drilling apparatus and method in which the drill bit can be rotated at a higher speed than the drill string, thereby allowing the selection of a bit speed to maximize the formation penetration rate while simultaneously reducing the stress on the drill string.

Yet another object of this invention is to provide an improved apparatus and method in which substantially the entire face of the bottom of the borehole is subjected to cutting elements traveling at relatively high speeds.

Still another object of this invention is to provide an improved apparatus and method for drilling boreholes in which the tendency to cut a core is avoided.

A further object of this invention is to provide an improved drilling apparatus and method in which the cutting elements of the drill bit are subjected to a more uniform rate of wear so as to extend the useful life of the drill bit.

A still further object of the invention is to provide an improved drilling apparatus and method in which the rate of formation penetration is increased by the use of higher drill bit rotational speeds applied uniformly across the entire face of the bottom of the borehole.

Still other objects, advantages and features of the invention will become apparent to those skilled in the art from the following description when taken in conjunction with the accompanying drawings.

SUMMARY OF THE INVENTION

Briefly, the invention provides an improved drilling apparatus and method for drilling a borehole. The apparatus of the invention includes (1) an undersized drill bit which is mounted eccentrically within the borehole for rotation about a first axis of rotation substantially parallel to and spaced from the axis of the borehole, (2) a downhole motor for rotating the drill bit, (3) a drill string for suspending the motor and drill bit in the borehole, and (4) a rotary device for rotating the drill string so as to rotate the drill bit in a planetary motion about the axis of the drill string. Preferably the diameter of the drill bit is between about 0.55 and about 0.90 times the diameter of the borehole, and the first axis of rotation is spaced from the axis of the drill string by a distance of about 0.5 times the difference between the diameter of the borehole and the diameter of the drill bit.

In the method of this invention, the undersized drill bit is rotated about the first axis of rotation in engagement with the bottom of the borehole and is simultaneously rotated in a planetary motion about a second axis of rotation substantially corresponding to the axis of the drill string. Preferably, the drill bit is rotated about the first axis of rotation at a relatively high speed selected to maximize formation penetration rate while the drill bit is rotated about the second axis of rotation at a relatively low speed selected to avoid excessive stress on the drill string.

The invention provides a drilling apparatus and method having a reduced tendency to core the borehole and a reduced tendency to wear the cutting elements of the drill bit in an uneven manner. In this invention, the entire surface being cut is traversed by cutting elements traveling at a high speed approaching the speed of the outermost cutting elements of the drill bit and the rate of formation penetration is therefore increased. The undersized bit also allows the removal of relatively large objects from the borehole without requiring removal of the drill string and bit.

BRIEF DESCRIPTION OF THE DRAWINGS

The invention will be more readily understood by reference to the drawings wherein like numerals refer to like elements, and in which.

DETAILED DESCRIPTION OF THE INVENTION

The apparatus and method of this invention are useful in all drilling operations and find particular utility in the drilling of relatively deep boreholes where conventional rotary drilling apparatus and methods cannot achieve satisfactory drilling rates due to excessive stress on the drill string and/or the time required to change prematurely worn drill bits. The apparatus and method of this invention are useful in the drilling of both straight and directional boreholes having a wide variety of borehole diameters.

Figure 1:
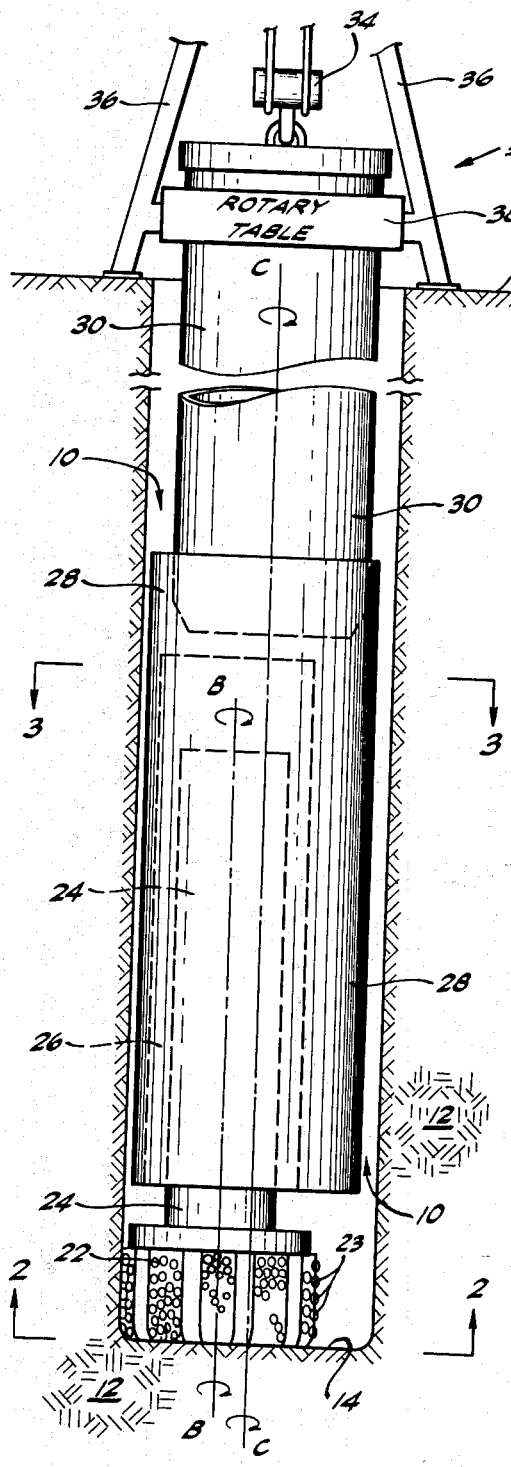
FIG. 1 is a schematic diagram illustrating a vertical cross-section of earth strata penetrated by a borehole in which is suspended one embodiment of the apparatus of this invention.

Referring to FIG. 1, cylindrical borehole 10 penetrates formation 12 and terminates at circular bottom surface 14. One embodiment of the apparatus of this invention, shown generally as 20, is disposed in borehole 10 so as to extend borehole 10 through formation 12. Apparatus 20 includes undersized drill bit 22 having a plurality of cutting elements 23, and cylindrical drive shaft 24 which is coupled to drill bit 22 and operably connected to downhole motor 26. Motor 26 is enclosed within stabilizer housing 28 which is suspended from drill string 30. Drill string 30 is supported at earth surface 32 by any suitable device, such as draw works 34 and derrick 36. Drill string 30 is adapted to be rotated about its axis, shown as axis C, by a rotary device, such as rotary table 38.

In vertical boreholes, the axis of drill string 30 will be substantially parallel to the axis of borehole 10 and typically will be aligned with the axis of borehole 10, whereas in nonvertical boreholes the axis of drill string 30 will deviate somewhat from the axis of the borehole. In any event, the bottom end of drill string 30 will be substantially coaxial with borehole 10 due to the centralizing effect of stabilizer housing 28 and/or other centralizing device, not shown. Rotary table 38 is adapted to rotate drill string 30 about its axis C and thereby rotate stabilizer housing 28, motor 26, drive shaft 24 and drill bit 22 about axis C.

Downhole motor 26 is adapted to rotate drive shaft 24 and drill bit 22 about an axis of rotation, shown as axis B, which is substantially parallel to and spaced from axis C. Axis B is spaced from axis C by a distance equal to one half of the difference between the diameter of borehole 10 and the diameter of drill bit 22, i.e., the offset distance is about 0.5 (D-d) where D is the diameter of borehole 10 and d is the diameter of drill bit 22. In this configuration the outermost cutting elements of drill bit 22 will cut the outermost edge of borehole 10 as drill bit 22 is rotated about axis C.

Any downhole motor capable of rotating drill bit 22 at the desired speed under the downhole conditions is suitable for use in the method of this invention. Downhole motor 26 may be a conventional downhole electric drilling motor powered by electricity conducted to motor 26 through electrical conduits, not shown, associated with drill string 30. Suitable downhole electric motors are disclosed in U.S. Pat. Nos. 2,531,120; 2,803,433; 3,007,534; 3,696,332; 3,280,923; 3,777,827; 4,031,969 and the like. Alternatively, downhole motor 26 may be a downhole fluid-driven motor, such as the positive displacement fluid motors disclosed in U.S. Pat. Nos. 2,753,801; 2,852,230; 3,076,514; 3,594,106; 3,627,048; 3,966,369; 3,976,408 and 3,986,370, or a fluid-driven turbine, such as disclosed in U.S. Pat No. 4,003,678. The use of any particular downhole motor is a matter of choice according to factors well known to those skilled in the art.

A wide variety of drill bits are suitable for use with the apparatus and method of this invention including diamond drill bits, roller cone drill bits and other conventional rotary drill bits. Non-coring rotary drill bits are preferred, particularly rotary drill bits having relatively flat cutting faces so as to reduce any tendency to cut a core. Diamond drill bits having relatively flat cutting faces are particularly suited for use with the apparatus of this invention due to their relatively long useful lives and their increased penetration rates at relatively high rotational speeds. Of course, the selection of a particular bit is made in view of the particular formation characteristics and the particular downhole motor employed as known in the art.

Figure 2:
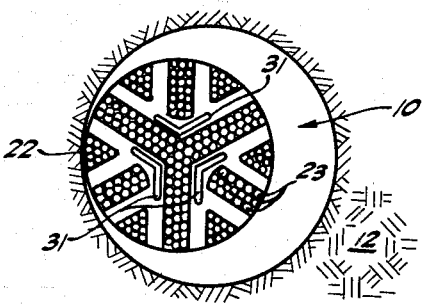

Referring to FIG. 2, the diameter of the drill bit is selected in view of the diameter of the borehole such that the drill bit diameter is greater than the radius but less than the diameter of the borehole. Preferably, the drill bit diameter is between about 0.55 and about 0.90 times the diameter of the borehole, and good results are achieved when the drill bit diameter is between about 0.6 and about 0.8 times the diameter of the borehole. In an exemplary embodiment of the apparatus of this invention, the diameter of drill bit 22 is about 0.75 times the diameter of borehole 10 and axis B is spaced from axis C by a distance of about 0.125 times the diameter of borehole 10, such that upon rotation about axes B and C the outermost edge of drill bit 22 will cut circular surface 14 so as to extend borehole 10 into formation 12.

In operation, the activation of drilling motor 26 will cause drive shaft 24 to rotate drill bit 22 about axis B in engagement with surface 14, and, simultaneously, rotary table 38 will cause drill string 30 to rotate about axis C thereby rotating housing 28, downhole motor 26 and drill bit 22 about axis C. Thus drill bit 22 is rotated about axis B and is simultaneously rotated in a planetary motion about axis C to thereby cut surface 14 so as to extend borehole 10 into formation 12.

Typically, a drilling fluid will be circulated from the earth surface downwardly through the interior of drill string 30 and housing 28 or motor 26 to drill bit 22. The drilling fluid exits from drill bit 22 through openings 31, flushes drilling cuttings and other particles from surface 14 and carries these particles upwardly through the annulus between housing 28 or drill string 30 and the walls of borehole 10 to earth surface 32. Where downhole motor 26 is a fluid-driven motor, typically at least a portion of the drilling fluid will flow through downhole motor 26 to drive the motor. In addition to cleaning drilling cuttings from the borehole, another important function of the drilling fluid is to cool the drill bit.

Figure 4:
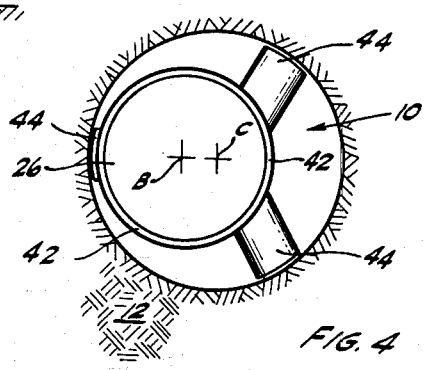
FIG. 4 is a schematic diagram illustrating an alternative embodiment of the apparatus illustrated in FIG. 3.
Figure 3:
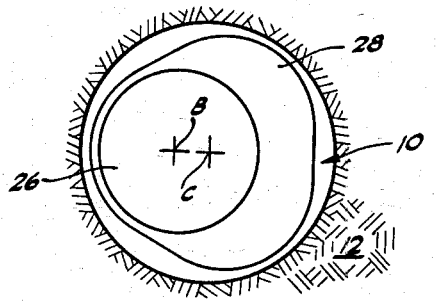
FIGS. 2 and 3 are schematic diagrams illustrating a horizontal cross-section of earth strata penetrated by a borehole and an apparatus of this invention, taken along lines 2—2 and 3—3, respectively, of FIG. 1.

Stabilizer housing 28 is adapted to stabilize the positions of drill string 30 and drill bit 22 within borehole 10 while allowing sufficient cross-sectional area for unrestricted flow of the drilling cuttings and drilling fluid to the earth surface. That is, stabilizer housing 28 serves to center drill string 30 within borehole 10 such that the bottom of drill string 30 is coaxially aligned with the bottom of borehole 10, and housing 28 serves to maintain axis B spaced from the axis of the bottom of borehole 10 by a distance of about 0.5 (D-d), as described above. In the preferred embodiment illustrated in FIGS. 1 and 3, stabilizer housing 28 is a long smooth housing having a multilobal, preferably trilobal, cross-section. An alternative embodiment of housing 28 is shown in FIG. 4, wherein housing 28 includes a cylindrical sheath 42 about downhole motor 26 and three radial fins 44 adapted to maintain the axis of downhole motor 26 and sheath 42 aligned with axis B. Radial fins 44 can extend vertically along the length of sheath 42 or fins 44 can spiral about sheath 42 with their radial length varying so as to maintain downhole motor 26 coaxially aligned with axis B.

As illustrated in FIGS. 1 through 4, it is preferred that downhole motor 26 be mounted eccentrically within borehole 10 such that the axis of motor 26 is aligned with the axis of rotation of drill bit 22, i.e., axis B. In this configuration, a rigid drive shaft having a common axis with motor 26 and drill bit 22 can be employed to directly drive drill bit 22. Alternatively, the downhole motor can be mounted so as to be coaxial with drill string 30 and a flexible drive shaft, not shown, or a series of gears, not shown, can be employed to couple the output of motor 26 to drill bit 22.

In the method of this invention, a drill bit having a diameter between about 0.55 and about 0.90 times the diameter of the borehole is rotated about a first axis of rotation spaced from the axis of the borehole and is simultaneously rotated in a planetary motion about a second axis of rotation substantially corresponding to the axis of the borehole. A downhole motor preferably rotates the drill bit about the first axis of rotation at a speed selected to maximize the penetration rate of the drill bit, such as a speed between about 100 and about 1000 r.p.m. Good results are obtained when the drill bit is a diamond drill bit rotated about the first axis of rotation at a speed between about 400 and about 800 r.p.m.

Preferably the drill bit is rotated about the second axis of rotation by means of a rotary device which rotates the drill string to which the downhole motor and drilling bit are attached. The rotational speed about the second axis of rotation will generally be lower than the rotational speed about the first axis of rotation. Preferably, the drill bit is rotated in a planetary motion about the second axis of rotation at a speed between about 5 and about 100 r.p.m., more preferably between about 10 and about 50 r.p.m.

While particular embodiments of the invention have been described, it will be understood, of course, that the invention is not limited thereto since many obvious modifications can be made and it is intended to include within this invention any such modifications as will fall within the scope of the appended claims.

Having now described the invention, I claim:

1. An apparatus for drilling a borehole, which comprises:

a single drill bit adapted for rotation about a first axis of rotation substantially parallel to the axis of said borehole, said drill bit having a diameter of between about 0.55 and about 0.90 times the diameter of said borehole;

downhole motor means operably connected to said drill bit for rotating said drill bit about said first axis of rotation;

a drill string connected to said motor means and adapted to suspend said motor means and said drill bit in said borehole, said drill string being rotatable about a second axis of rotation substantially parallel to said first axis of rotation and spaced from said first axis of rotation by a distance of about 0.5 times the difference between the diameter of said borehole and the diameter of said drill bit; and rotary means for rotating said drill string about said second axis of rotation and thereby rotate said drill bit in a planetary motion about said second axis of rotation.

2. The apparatus defined in claim 1 wherein said motor means includes (1) a drive shaft fixedly connected to said drill bit and rotatable about said first axis of rotation and (2) a downhole motor fixedly connected to said drill string so as to be axially aligned with said first axis of rotation, said downhole motor being adapted to rotate said drive shaft and said drill bit about said first axis of rotation.

3. The apparatus defined in claim 1 further comprising stabilizer means coupled to said motor means and adapted to stabilize the positions of said motor means and said drill string within said borehole such that said second axis of rotation is substantially aligned with the axis of the bottom of said borehole.

4. The apparatus defined in claim 1 wherein said motor means include a fluid-driven downhole motor and wherein said drill string is a tubular drill string adapted to conduct a pressurized drilling fluid to said downhole motor for driving said downhole motor.

5. The apparatus defined in claim 1 wherein the diameter of said drill bit is between about 0.6 and about 0.8 times the diameter of said borehole.

6. An apparatus for drilling a borehole, which comprises:

a single drill bit adapted for rotation about a first axis of rotation substantially parallel to the axis of said borehole, said drill bit having a diameter between about 0.6 and about 0.8 times the diameter of said borehole;

a drive shaft fixedly coupled to said drill bit and rotatably about said first axis of rotation;

a downhole motor operably connected to said drive shaft and axially aligned with said first axis of rotation, said motor being adapted to rotate said drive shaft and said drill bit about said first axis of rotation;

a tubular drill string connected to said downhole motor and adapted to suspend said downhole motor in said borehole, said drill string being rotatable about a second axis of rotation parallel to said first axis of rotation and spaced from said first axis of rotation by a distance of about 0.5 times the difference between the diameter of said borehole and the diameter of said drill bit;

suspension means connected to the upper end of said drill string for suspending said drill string in said borehole;

rotary means operably connected to said drill string for rotating said drill string about said second axis of rotation; and stabilizer means connected to said downhole motor for stabilizing the positions of said downhole motor and the lower end of said drill string such that said second axis of rotation is substantially aligned with the axis of the bottom of said borehole.

7. The apparatus defined in claim 6 wherein said stabilizer means includes a stabilizer housing surrounding and connected to said downhole motor, said stabilizer housing having a multilobal cross-section adapted to maintain said downhole motor axially aligned with said first axis of rotation.

8. The apparatus defined in claim 6 wherein said downhole motor is a fluid-driven motor and wherein said drilling string is adapted to conduct a pressurized drilling fluid to said downhole motor to drive said downhole motor.

9. A method for drilling a borehole, which comprises:

suspending a downhole motor in said borehole by means of a drill string;

causing said downhole motor to rotate a single drill bit at a first speed about a first axis of rotation in engagement with the bottom of said borehole, said drill bit having a diameter between about 0.55 and about 0.90 times the diameter of said borehole, and said first axis of rotation being substantially parallel to the axis of said borehole; and simultaneously rotating said drill string so as to rotate said drill bit in a planetary motion at a second speed about a second axis of rotation substantially parallel to said first axis of rotation and spaced from said first axis of rotation by a distance of about 0.5 times the difference between the diameter of said borehole and the diameter of said drill bit.

10. The method defined in claim 9 wherein said first speed is between about 100 and about 1000 revolutions per minute.

11. The method defined in claim 9 wherein said first speed is between about 400 and about 800 revolutions per minute.

12. The method defined in claim 9 wherein said second speed is between about 5 and about 100 revolutions per minute.

13. The method defined in claim 9 wherein said second speed is between about 10 and about 50 revolutions per minute.

14. The method defined in claim 9 wherein the diameter of said drill bit is between about 0.6 and about 0.8 times the diameter of said borehole.

15. A method for drilling a borehole which comprises:

suspending a downhole motor in said borehole by means of a tubular drill string;

causing said downhole motor to rotate a single drill bit with diamond cutting elements at a first speed about a first axis of rotation in engagement with the bottom of said borehole, said drill bit having a diameter between about 0.6 and about 0.8 times the diameter of said borehole, said first speed being between about 400 and about 800 revolutions per minute, and said first axis of rotation being substantially parallel to the axis of said borehole;

simultaneously rotating said drill string so as to rotate said drill bit at a second speed in a planetary motion about a second axis of rotation substantially parallel to said first axis of rotation and spaced from said first axis of rotation by a distance of about 0.5 times the difference between the diameter of the borehole and the diameter of said drill bit, said second speed being between about 10 and about 50 revolutions per minute; and circulating a drilling fluid from the earth surface downwardly through a first fluid pathway in said borehole to the drill bit and then upwardly through a second passageway in said borehole to the earth surface so as to remove from said borehole drilling cuttings generated by rotation of said drill bit in engagement with the bottom of said borehole.

16. The method defined in claim 15 wherein said downhole motor is a fluid-driven motor and wherein at least a portion of said drilling fluid is passed through said downhole motor to drive said motor.

17. A method for drilling a borehole, which comprises:

suspending a downhole motor in said borehole by means of a tubular drill string;

rotatably stabilizing said downhole motor within said borehole by means of a stabilizer housing connected thereto so as to maintain said downhole motor in axial alignment with a first axis of rotation substantially parallel to and spaced from the axis of said borehole, said stabilizer housing having a multilobal cross-section;

simultaneously (1) causing said downhole motor to rotate a single drill bit at a first speed about said first axis of rotation in engagement with the bottom of said borehole, said drill bit having a diameter between about 0.55 and about 0.90 times the diameter of said borehole, and (2) rotating said drill string so as to rotate said drill bit in a planetary motion at a second speed about a second axis of rotation substantially parallel to said first axis of rotation and spaced from said first axis of rotation by a distance of about 0.5 times the difference between the diameter of said borehole and the diameter of said drill bit; and circulating a drilling fluid from the earth surface downwardly through said drill string to the drill bit and then upwardly through at least one passageway between the lobes of said stabilizer housing to the earth surface.

18. An apparatus for drilling a borehole, which comprises:

a single drill bit adapted for rotation about a first axis of rotation substantially parallel to the axis of said borehole, said drill bit having a diameter of between about 0.55 and about 0.90 times the diameter of said borehole;

downhole motor means operably connected to said drill bit for rotating said drill bit about said first axis of rotation;

a drill string connected to said motor means and adapted to suspend said motor means and said drill bit in said borehole, said drill string being rotatable about a second axis of rotation substantially parallel to said first axis of rotation and spaced from said first axis of rotation by a distance of about 0.5 times the difference between the diameter of said borehole and the diameter of said drill bit;

a stabilizer housing connected to and surrounding said downhole motor means for stabilizing the positions of said motor means and said drill string within said borehole such that said second axis is substantially aligned with the axis of the bottom of said borehole, said stabilizer housing having a multilobal cross-section; and rotary means for rotating said drill string about said second axis of rotation and thereby rotate said drill bit in a planetary motion about said second axis of rotation.

19. An apparatus for drilling a borehole, which comprises:

a single drill bit adapted for rotation about a first axis of rotation substantially parallel to the axis of said borehole, said drill bit having a diameter between about 0.6 and about 0.8 times the diameter of said borehole;

a drive shaft fixedly coupled to said drill bit and rotatable about said first axis of rotation;

a fluid-driven downhole motor operably connected to said drive shaft and axially aligned with said first axis of rotation, said motor being adapted to rotate said drive shaft and said drill bit about said first axis of rotation;

a tubular drill string connected to said downhole motor, said drill string being adapted to suspend said downhole motor in said borehole and to conduct a pressurized drilling fluid to said downhole motor, and said drill string being rotatable about a second axis of rotation parallel to said first axis of rotation and spaced from said first axis of rotation by a distance of about 0.5 times the difference between the diameter of said borehole and the diameter of said drill bit;

suspension means connected to the upper end of said drill string for suspending said drill string in said borehole;

rotary means operably connected to said drill string for rotating said drill string about said second axis of rotation; and a stabilizer housing connected to and surrounding said downhole motor for stabilizing the positions of said downhole motor and the lower end of said drill string such that said second axis of rotation is substantially aligned with the axis of the bottom of said borehole, said stabilizer housing having a multilobal cross-section.

* * * * *

UNITED STATES PATENT AND TRADEMARK OFFICE

CERTIFICATE OF CORRECTION

PATENT NO. : 4,267,893

DATED : May 19, 1981

INVENTOR(S) : Alfred T. Mannon, Jr.

It is certified that error appears in the above-identified patent and that said Letters Patent are hereby corrected as shown below:

In Column 6, Line 18, in Claim 4, the third word, "include" should read --includes--;

In Column 6, Line 33, in Claim 6, the word "rotatably" should read --rotatable--.

Signed and Sealed this

*Eighteenth* Day of *August 1981*

[SEAL]

*Attest:*

GERALD J. MOSSINGHOFF

*Attesting Officer*

*Commissioner of Patents and Trademarks*